US005513502A

United States Patent [19]

Seaton, Jr.

[11] Patent Number: 5,513,502

[45] Date of Patent: May 7, 1996

[54] EAR CLIP FOR AN EARRING

[75] Inventor: Willard F. Seaton, Jr., Kingston, R.I.

[73] Assignee: B. A. Ballou & Co., Inc., East Providence, R.I.

[21] Appl. No.: 223,958

[22] Filed: Apr. 7, 1994

[51] Int. Cl.[6] ..... A44C 7/00

[52] U.S. Cl. ..... 63/14.4

[58] Field of Search ..... 63/14.1, 14.4, 63/14.5, 14.6, 14.8

[56] References Cited

U.S. PATENT DOCUMENTS

| | | | |
|---|---|---|---|
| 2,303,267 | 11/1942 | Goodwin | 63/14.4 |
| 2,389,481 | 11/1945 | Bazner | 63/14.4 |
| 2,433,737 | 12/1947 | Chernow | 63/14.4 |
| 2,516,652 | 7/1950 | Silverman | 63/14.4 |
| 2,618,831 | 11/1952 | Gloss | 63/14.4 |
| 2,745,264 | 5/1956 | Jaron | 63/14.4 |
| 2,773,293 | 12/1956 | Watson | 24/252 |
| 3,465,542 | 9/1969 | Pintarelli | 63/14.4 |
| 3,483,715 | 12/1969 | Kettell | 63/14.4 |
| 3,568,271 | 3/1971 | Saccoccio et al. | 63/14.4 |
| 4,187,696 | 2/1980 | Van Bergen | 63/14.4 |
| 5,170,644 | 12/1992 | Calabro | 63/14.4 |

FOREIGN PATENT DOCUMENTS

| | | | |
|---|---|---|---|
| 264642 | 9/1964 | Australia | 63/14.4 |
| 245844 | 3/1966 | Austria . | |
| 1156805 | 5/1958 | France . | |
| 1166757 | 11/1958 | France . | |
| 1476796 | 4/1967 | France . | |
| 692625 | 8/1965 | Italy | 63/14.4 |
| 284160 | 11/1952 | Switzerland | 63/14.4 |
| 598208 | 2/1948 | United Kingdom . | |
| 976341 | 11/1964 | United Kingdom | 63/14.4 |

OTHER PUBLICATIONS

Ballou brochure, Jul., 1991, pp. 21, 29, 30, 31.

*American Jewelry Manufacturer,* Mar., 1994.

*Primary Examiner*—Michael J. Milano

*Attorney, Agent, or Firm*—Fish & Richardson

[57] ABSTRACT

An ear clip for an earring comprising a connector and a clip arm, the connector being adapted to attach to an ornamental piece and having a first cup, the clip arm having a second cup which receives the first cup to form a pivot, the pivot creating a friction fit between the cups so as to allow the clip arm to be positioned as desired with respect to an earlobe.

11 Claims, 1 Drawing Sheet

EAR CLIP FOR AN EARRING

FIELD OF THE INVENTION

This invention relates to the field of jewelry clips and more particularly to an ear clip for a hinged type of earring.

BACKGROUND OF THE INVENTION

There are several types of arrangements by which earrings are held to an earlobe. Earrings for pierced ears, for example, employ a post with a cap. Another arrangement involves a screw-threaded post, which can be tightened against the earlobe. Another common arrangement involves the use of a hinged arm of some type, wherein the arm, which is often spring-loaded, presses against the earlobe. In the latter case, the earring usually has two basic parts, an ornamental piece and the attachment mechanism including the arm, which is called an ear clip.

There are several drawbacks to such prior art ear clips. First, many prior art ear clips of the hinge type are made of a number of separate parts, and some of these necessarily small parts are rather complex. This significantly increases the cost of the mechanism. The amount of force exerted by the hinge-type clip is also a problem. Most prior art ear clips have one setting which is used by everyone regardless of earlobe thickness or individual preference. Hence, a prior art ear clip may be too tight and uncomfortable for some wearers and too loose for others. The former problem is particularly acute if the mechanism includes the usual spring-biasing means to help keep the arm in its closed setting against the earlobe.

A further drawback of the prior art ear clips of the hinged type is that the device lacks aesthetic appeal. Because of the number of parts, their sizes and shapes, the mechanism is neither symmetrical nor simple, which detracts from the earring's appearance.

Accordingly, one object of this invention is to provide an earring or other piece of jewelry with an improved attachment clip.

Another object of the invention is to provide an ear clip for an earring which uses the frictional resistance between its parts to set and hold the positioning of its arm with respect to the earlobe as desired.

Another object of the invention is to provide an ear clip for an earring wherein the clip has few parts and is easy to manufacture.

Another object of the invention is to provide an ear clip for an earring wherein the main features of its moveable parts are enclosed and hidden from view.

Another object of the invention is to provide an ear clip for an earring, having a compact connection between its moving pieces.

SUMMARY OF THE INVENTION

The invention comprises an ear clip for an earring having a connector and a clip arm. The connector is adapted to be attached to an ornamental piece for the earring, and the clip arm is pivotably attached to the connector at a joint so that the arm can be positioned as desired and held in any such position by the frictional resistance between the connector and arm at the joint.

In the preferred embodiment, a connector comprises an attachment foot, a neck, and a cup. The foot is essentially flat and adapted to attach to an ornamental piece by soldering, gluing or other conventional means. The neck extends from one end of the foot and supports an attachment cup having a lip. The clip arm comprises an expanded engagement paddle and a shank. Two receiving cups having lips are disposed on the end of the shank, and the cup of the connector fits therebetween to form a joint about which the engagement paddle can pivot. A friction fit is obtained between the cup and its lip of the connector and the receiving cups and their lips of the clip arm so that the engagement paddle can be held at a variety of different angles with respect to the connector. In operation, the engagement paddle engages the earlobe of the wearer, and the amount of force exerted by the engagement paddle on the earlobe is adjustable by changing the position of the engagement paddle with respect to the connector.

DESCRIPTION OF THE PREFERRED EMBODIMENTS

I turn now to a detailed description of the preferred embodiment, after first describing the drawings.

Structure

Figure 1A:
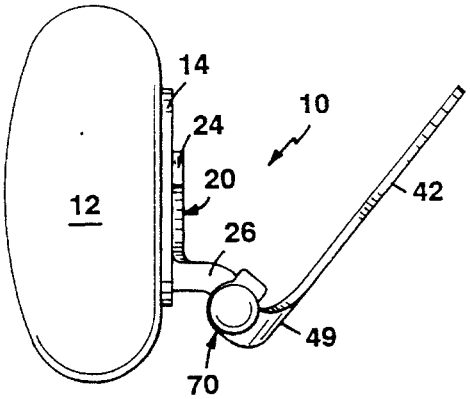
FIGS. 1A and 1B are side views of an earring with an ear clip of the preferred embodiment, showing a clip arm in different positions.
Figure 1B:
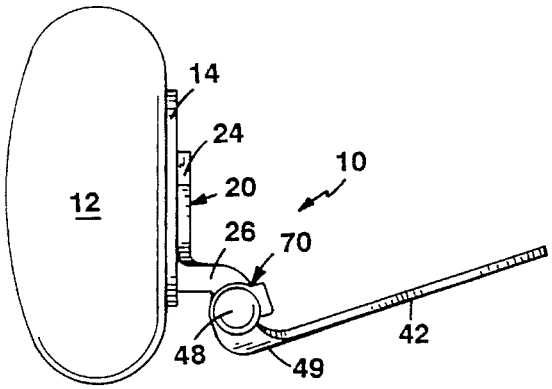

Referring to FIGS. 1A and 1B, an earring incorporating the invention is shown at 10. The earring 10 generally comprises an ornamental piece 12 having a back 14 and an ear clip 20. The earring 10, however, is just illustrative, and other types of jewelry articles may be used with the clip 20.

Figure 2:
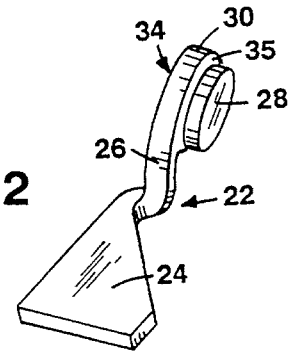
FIG. 2 is a perspective view of a connector of the preferred embodiment prior to assembly.
Figure 4:
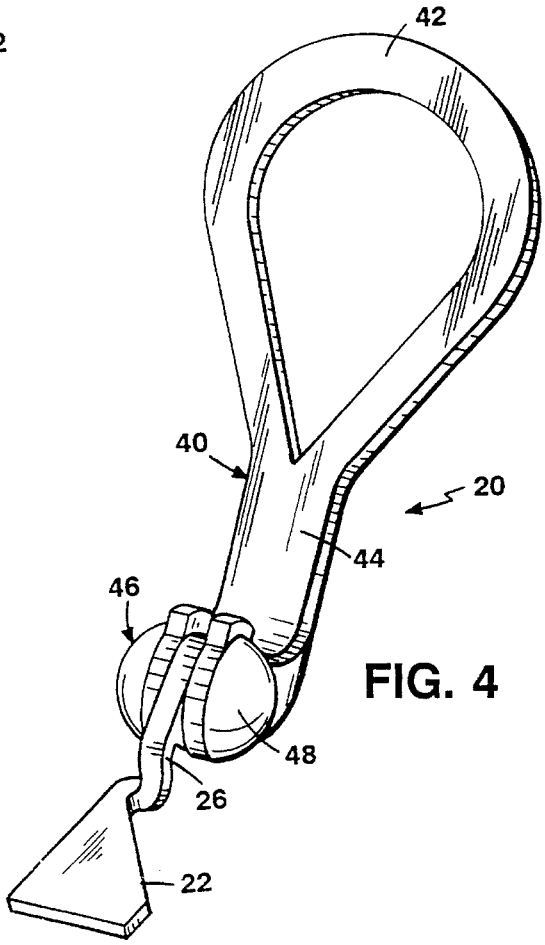
FIG. 4 is a perspective view of the assembled connector and clip arm of the preferred embodiment of the invention.

Referring to FIG. 4, the ear clip 20 generally comprises a connector 22 and a clip arm 40. The connector 22 is best shown in FIG. 2. It has a foot 24, which is attached to the back 14 of the ornamental piece 12 of the earring 10 when the ear clip 20 is in place. The foot 24 may be attached to the back 14 by soldering, gluing or other means. The foot 24 of the preferred embodiment is trapezoidal in shape, but other shapes are possible. The connector 22 has a neck 26 which extends from one end of the foot 24 at approximately a right angle. The end of the neck 26 opposite the foot 24 is attached to a hollow, cylindrical cup 28 having a rounded outer surface 30 bounded by a lip 35 having a surface 34 opposite the cup 28. The connector 22 is made of a single piece of copper, although other materials may be used. The cup 28, which is sometimes referred to as a blind hole in the metal fabrication industry, is formed by striking or by coining it into the metal. Other methods of making the cup 28 are also possible.

Figure 3:
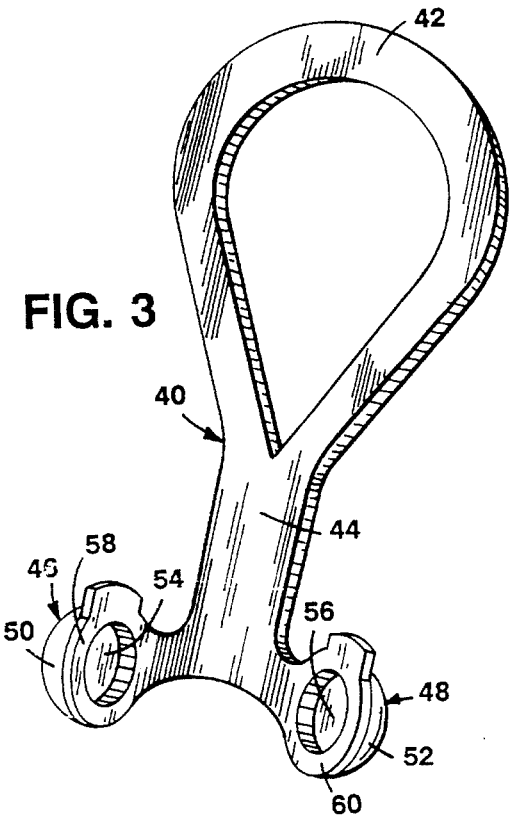
FIG. 3 is a perspective view of a clip arm of the preferred embodiment prior to assembly.

The unassembled clip arm 40 is best shown in FIG. 3. Clip arm 40 comprises an engagement paddle 42, which is integral with a shank 44. In the preferred embodiment, engagement paddle 42 has the shape of a loop, although other shapes are possible. Two cups 46, 48 are disposed opposite each other on the end of the shank 44 away from the engagement paddle 42. The paddle 42, the shank 44 and the cups 46, 48 are made of a single, thin piece of metal, which is stamped from strip stock using common metal stamping operations including punching, notching, parting, bending or coining. The cups 46, 48 have rounded outer surfaces 50, 52, recesses 54, 56 and lips 58, 60 which bound the recesses 54, 56. The cups 46, 48 are made in the same manner as the cup 28 of the connector 20. However, the cups 46, 48 are larger than cup 28, and cup 28 is designed to fit inside the recesses 54, 56 of cups 46, 48.

The assembled ear clip 20 is best shown in FIG. 4. The cup 28 of the connector 20 fits inside recess 56 of cup 48 of the clip arm 40, and the cups 46, 48 are pressed together so that lip 58 of cup 46 contacts surface 34 of cup 28. This is accomplished by use of a press, which pinches the cups 46, 48 together when the cup 28 is in place in the recess 56. The cups 46, 48 are then struck on their top 49 so as to remove any inherent resiliency of the cups 46, 48, which might tend to separate them. This forms a joint 70, wherein both cups 46, 48 effectively press on the captured portioned of the connector 20 so that the lips 58, 60 on the cups 46, 48 respectively press on the surface 34 and the lip 35 of the cup 28 forming a friction fit therewith. It should be noted that cup 46 is not actually needed and can be replaced by a flat surface. However, the appearance of the ear clip 20 is made symmetrical by the addition of cup 46. Of course, it is also possible to have a pair of cups disposed on the connector 22, which capture a single cup disposed on the clip arm shank.

When assembled, the foot 24 is attached to the back 14 of the ornamental piece 12, as shown in FIGS. 1A and 1B. In operation, the earlobe of the wearer fits between the engagement paddle 42 and the back 14 of the ornamental piece 12. Because of the friction fit at the joint 70, however, the engagement paddle 42 can be positioned at any angle desired, and it will remain in that position until physically moved by the wearer. Thus, any wearer discomfort is avoided, as the amount of pressure exerted by the engagement paddle 42 on the earlobe is controlled by the wearer, while still providing a suitably tight fit to prevent loss of the earring.

Other embodiments and advantages of the invention will be apparent to those skilled in the art.

What I claim is:

1. An ear clip for holding an earring to an earlobe comprising a connector, said connector having a single extension with a first flat surface and a second flat surface, said first and second surfaces being disposed opposite and parallel to each other, said connector also having a first cup projecting from said first surface, and a clip arm, said clip arm having a contact means for contacting the earlobe when said ear clip is in use, and a receiving means, said receiving means comprising a single pair of parallel arms, said arms having a third flat surface and a fourth flat surface respectively, said third and fourth flat surfaces mating with and contacting said first surface and said second surface respectively of said connector, regardless of the orientation of said connector and said clip arm so as to create a joint whereby the frictional resistance is constant between said surfaces at said joint permitting said contact means to be pivoted and set in a variety of different positions with respect to the earlobe so as to increase or decrease the holding pressure exerted by said contact means on the earlobe.

2. The ear clip of claim 1 wherein said receiving means further comprises a second cup having a rounded recess, said recess of said second cup receiving said first cup to form said joint.

3. The ear clip of claim 2 wherein said fourth surface is disposed opposite to said second cup and contacts said second surface so as to retain said first cup in said recess of said second cup.

4. The ear clip of claim 3 wherein said fourth surface comprises a lip on a third cup, said third cup being disposed on said clip arm opposite said second cup.

5. The ear clip of claim 4 wherein said connector comprises a foot adapted to be attached to an ornamental piece for the earring, said foot having a neck, and said first cup being disposed on said neck.

6. An earring comprising an ornamental piece a connector, said connector having an attachment means for attaching said connector to said ornamental piece and having a single extension with a first flat surface and a second flat surface, said first and second surfaces being disposed opposite and parallel to each other, said connector also having a first cup projecting from said first surface, and a clip arm, said clip arm having a contact means for selectively contacting the earlobe between said contact means and said ornamental piece when said earring is in use, and a receiving means, said receiving means comprising a single pair of parallel arms, said arms having a third flat surface and a fourth flat surface respectively, said third and fourth flat surfaces mating with and contacting said first surface and said second surface respectively of said connector, regardless of the orientation of said connector and said clip arm so as to create a joint whereby the frictional resistance is constant between said surfaces at said joint, permitting said contact means to be pivoted and set in a variety of different positions with respect to the earlobe so as to increase or decrease the holding pressure exerted by said contact means on the earlobe.

7. The earring of claim 6 wherein said receiving means further comprises a second cup having a rounded recess, said recess of said second cup receiving said first cup to form said joint.

8. The earring of claim 7 wherein said fourth surface is disposed opposite to said second cup and contacts said second surface so as to retain said first cup in said recess of said second cup.

9. The earring of claim 8 wherein said fourth surface comprises a lip on a third cup, said third cup being disposed on said clip arm opposite said second cup.

10. The earring of claim 9 wherein said connector comprises a foot which is attached to said ornamental piece, said foot having a neck and said first cup being disposed on said neck.

11. A clip for holding a piece of jewelry in place comprising a connector, said connector having a single extension with first flat surface and a second flat surface, said first and second surfaces being disposed opposite and parallel to each other, said connector also having a first cup projecting from said first surface and a clip arm, said clip arm having a contact means and a receiving means, said receiving means comprising a single pair of parallel arms, said arms having a third flat surface and a fourth flat surface respectively, said third and fourth flat surfaces mating with and contacting said first surface and said second surface respectively of said connector, regardless of the orientation of said connector and said clip arm so as to create a joint whereby the frictional resistance is constant between said surfaces at said joint, permitting said contact means to be pivoted and set in a variety of different positions.

* * * * *